US007849830B2

(12) United States Patent
Maul et al.

(10) Patent No.: US 7,849,830 B2
(45) Date of Patent: Dec. 14, 2010

(54) SPARK PLUG

(76) Inventors: Georg Maul, Salvatorianer Weg 14, 88410 Bad Wurzach (DE); Reinhard Latsch, Bernhardstrasse 32, 76530 Baden-Baden (DE); Dieter Kuhnert, Friedrich-Metz-Strasse 18, 74889 Sinsheim (DE)

( * ) Notice: Subject to any disclaimer, the term of this patent is extended or adjusted under 35 U.S.C. 154(b) by 349 days.

(21) Appl. No.: 12/085,037

(22) PCT Filed: Nov. 29, 2006

(86) PCT No.: PCT/EP2006/011437

§ 371 (c)(1),
(2), (4) Date: May 14, 2008

(87) PCT Pub. No.: WO2007/068349

PCT Pub. Date: Jun. 21, 2007

(65) Prior Publication Data

US 2009/0255500 A1 Oct. 15, 2009

(30) Foreign Application Priority Data

Dec. 14, 2005 (DE) ..... 10 2005 060 166

(51) Int. Cl.
*H01T 13/06* (2006.01)
*H01T 13/40* (2006.01)
*H01F 38/12* (2006.01)

(52) U.S. Cl. ..... 123/169 R; 123/634; 123/143 C

(58) Field of Classification Search ..... 123/143 C, 123/169 R, 169 PA, 634, 635, 647; 439/125–128; 174/20, 30
See application file for complete search history.

(56) References Cited

U.S. PATENT DOCUMENTS

| | | | | |
|---|---|---|---|---|
| 2,198,250 A | | 4/1940 | Hurley | |
| 2,686,510 A | * | 8/1954 | Platner | 123/143 C |
| 2,686,511 A | * | 8/1954 | Platner | 123/143 C |
| 4,221,452 A | | 9/1980 | Remington | |
| 4,824,385 A | | 4/1989 | Sturdevan | |
| 5,554,908 A | | 9/1996 | Kuhnert et al. | |
| 5,799,633 A | * | 9/1998 | Miller | 123/143 C |

FOREIGN PATENT DOCUMENTS

| | | | | | |
|---|---|---|---|---|---|
| DE | 246488 | A | | 7/1910 | |
| DE | 30 29 557 | A1 | | 11/1981 | |
| DE | 195 00 216 | A1 | | 7/1996 | |
| DE | 199 50 932 | A1 | | 4/2001 | |
| GB | 2 077 350 | A | | 12/1981 | |
| GB | 2 077 851 | A | | 12/1981 | |
| JP | 2004100510 | A | * | 4/2004 | 123/169 R |

* cited by examiner

*Primary Examiner*—Willis R Wolfe, Jr.

(57) ABSTRACT

A spark plug for igniting a combustible gas mixture in an internal combustion engine includes an ignition electrode with an electrical supply line is connected thereto. A pipe housing is provided for enclosing the electrical supply line and a venting channel is provided for discharging combustion gases from the pipe housing. The venting channel provides for discharging combustion gases infiltrating the spark plug as leakage gases run along the supply line.

16 Claims, 3 Drawing Sheets

SPARK PLUG

Figure 1:
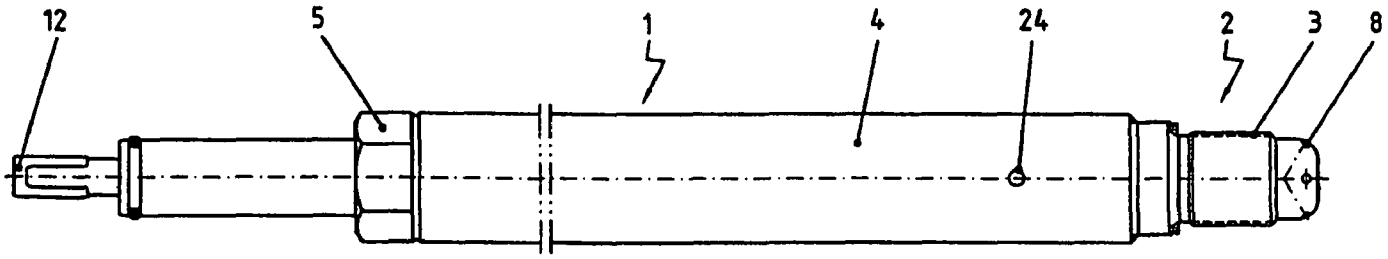

The invention relates to a spark plug for igniting a combustible gas mixture in an internal combustion engine, comprising an ignition electrode that is connected to an electrical supply line, a pipe housing in which runs the electrical supply line, and a venting channel for discharging combustion gases from then pipe housing.

The object of the invention is to increase the working life and the operating reliability of a spark plug.

In accordance with the invention, this object is attained by a spark plug of above-mentioned type in which the venting channel for discharging combustion gases infiltrating the spark plug as leakage gases runs along the supply line.

In principle, the venting channel can run outside of the supply line, e.g., in a groove in a cable sheath. Preferably, the venting channel runs along the supply line but inside the connecting supply line. Particularly beneficial and therefore preferred is to configure the supply line as a flexible cable, whose cable sheath encircles the venting channel; it is especially preferred that the cable is provided with a flexible cord whereby the venting channel is formed by the interstices between the stranded wires of the flexible cord.

It is possible that peak pressures of an order of magnitude of 150 bars can occur in an internal combustion engine. While in operation, these peak pressures exert a load on a spark plug and, even with true to size manufacturing and a thorough sealing, this can cause small amounts of combustion gases to leak from the engine and to reach as leakage gases, e.g., through sealing points between an insulation element and an electrode connection traversing (center electrode) it, the inside of the spark plug surrounded by the pipe housing.

Within the scope of the invention it was recognized that leakage gases increase the risk of shunts and that in this manner they can be detrimental to spark plugs. By way of example, leakage gases can cause a built up of pressure inside the pipe housing, which may lead to tearing up of insulation layers and thus to a premature failure of the spark plug. By means of a venting channel according to the invention, it is possible to remove leakage gases from the pipe housing. Detrimental effects of the leakage gases can be thus prevented and, consequently, the working life of the spark plug can be increased.

Leakage gases that reach the inside of the pipe housing, and thus the supply line, particularly through an insulation point between the insulation element and an electrode connection led through the insulation element, can be efficiently discharged by means of the venting channel. It is especially preferable that the venting channel runs in the supply line itself, which is preferably configured as a flexible cable, so that during assembly it is possible to adjust misalignments and tolerances.

However, combustion gases can reach into the inside of the spark plug not only as leakage gases. By way of example, should too high a peak pressure be generated by a poorly adjusted gas mixture, this pressure can push parts of the spark plug, especially the insulation element, into the pipe housing. If the peak pressure is high enough, it is possible that, just like a bullet in a rifle barrel, parts of the spark plug in the pipe housing are forcefully accelerated so that individuals could be injured or systems parts could be damaged. This danger of accident can be removed by venting channels that are provided as openings, e.g. as lateral borings, in a lateral area of the pipe housing and which in such a case facilitate the dissipating of the combustion gases.

Further details and advantages of the invention are explained by way of embodiments with reference to the accompanying illustrations. Identical parts or parts corresponding to each other of the various embodiments are indicated by the same reference numbers. The described features can be applied individually or in combination in order to create favorable embodiments of the invention.

Figure 2:
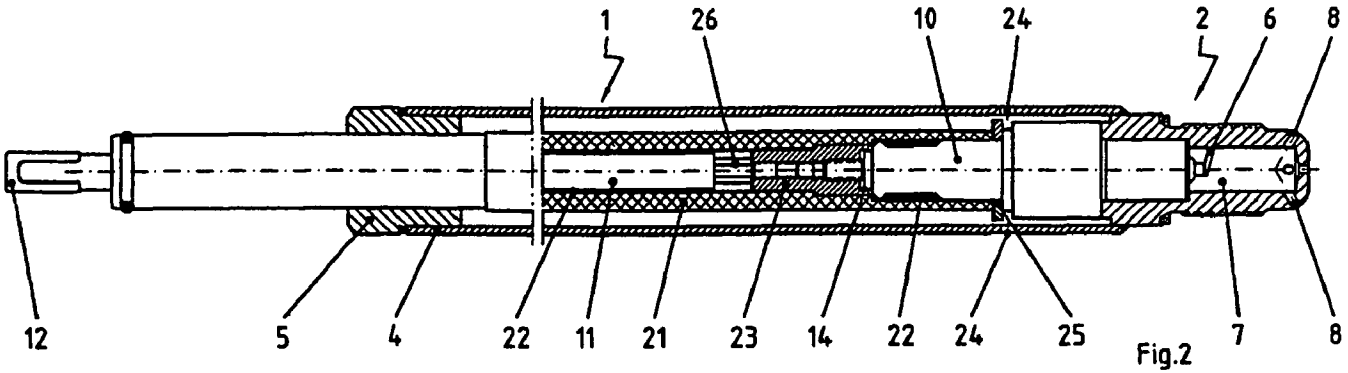
Figure 3:
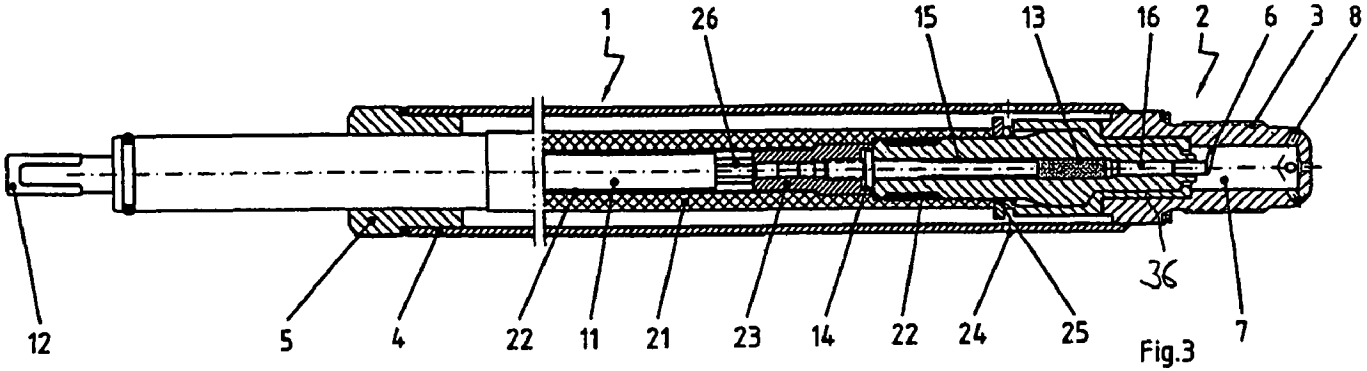
Figure 4:
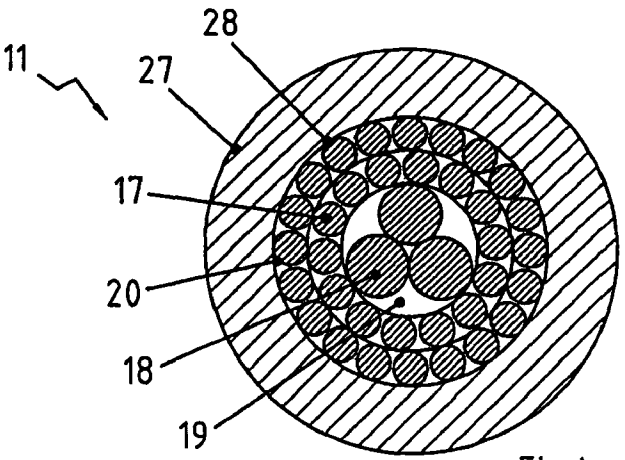
Figure 6:
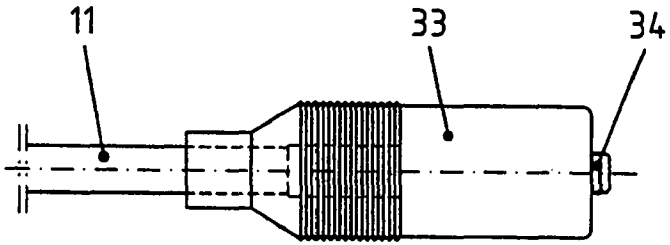
Figure 5:
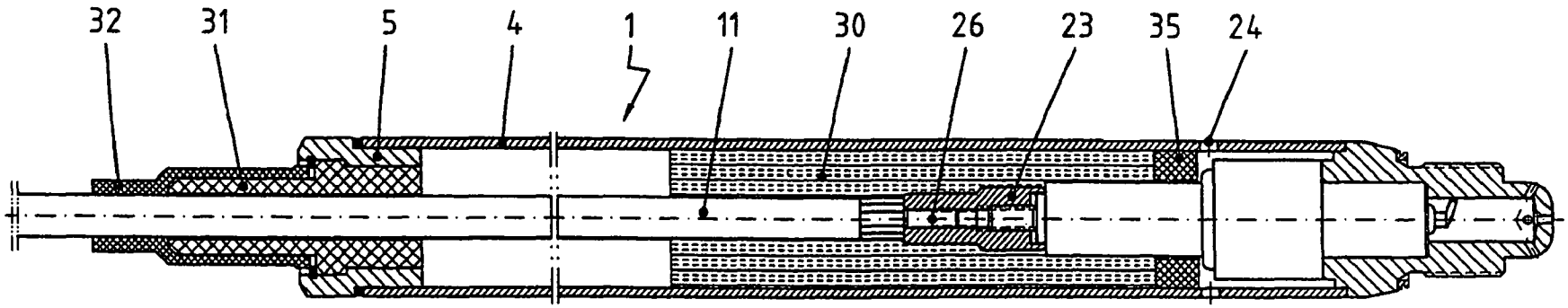
Figure 7:
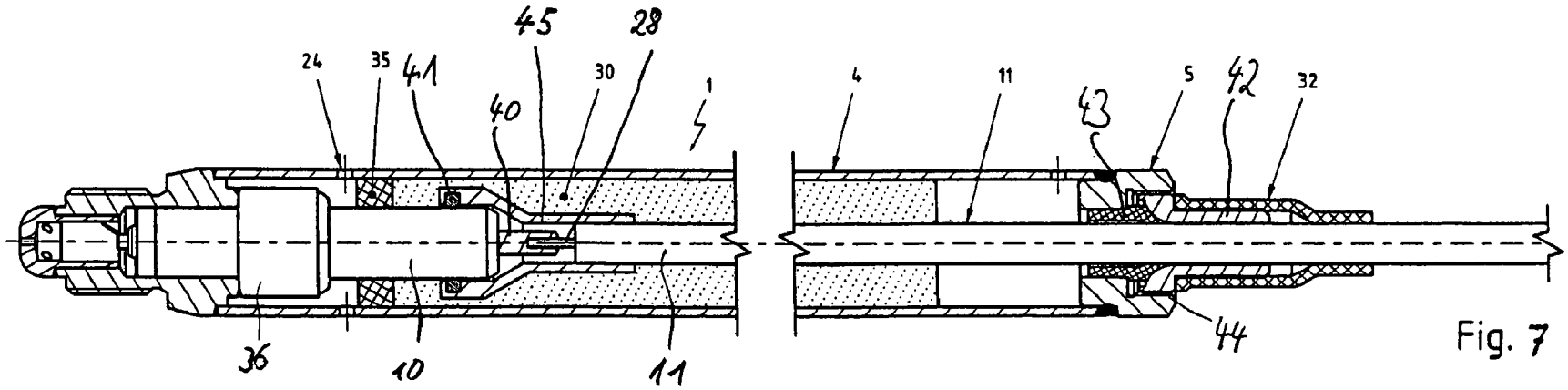
Figure 8:
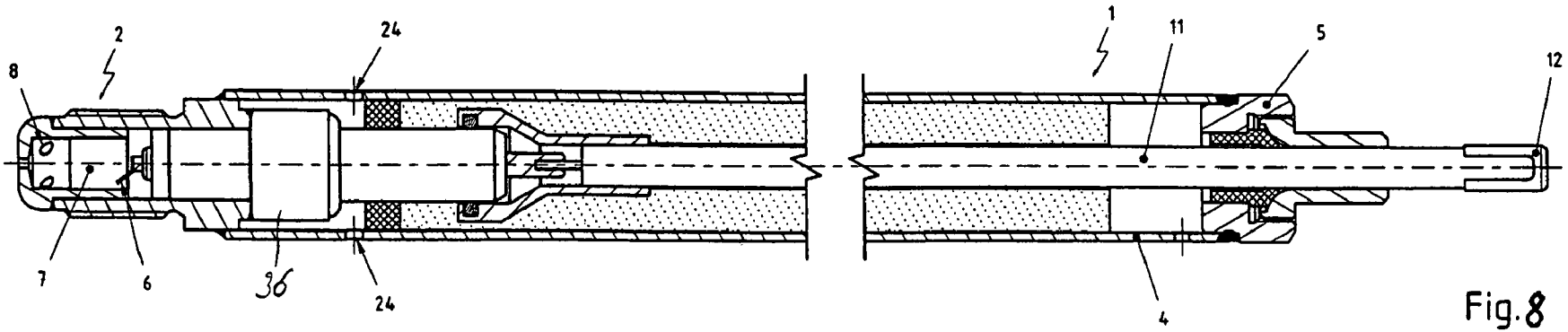

FIG. 1 shows a lateral view of an embodiment of a spark plug according to the invention;

FIG. 2. shows a partial sectional view of the embodiment shown in FIG. 1;

FIG. 3. shows a longitudinal section of the embodiment shown in FIG. 1;

FIG. 4. shows a cross-sectional view of the electric supply line with integrated venting channel of the embodiment shown in FIG. 1;

FIG. 5. shows a longitudinal section of another embodiment of a spark plug according to the invention;

FIG. 6. shows a coil plug at the free end of the supply line of the embodiment shown in FIG. 5;

FIG. 7. shows a longitudinal section of another embodiment of a spark plug in accordance with the invention;

FIG. 8. shows a longitudinal section of another embodiment of a spark plug in accordance with the invention.

The spark plug 1 shown in FIG. 1 has an ignition head 2 with an external thread 3 to be screwed into a combustion engine and a pipe housing 4 that bears the ignition head 2. At the opposite end of the ignition head, the pipe housing 4 is provided with a hexagon 5 that can be subjected to a torque for the screwing in of the spark plug 1. Due to the length of the pipe housing 4, the hexagon 5 is easier accessible to facilitate the mounting and the removal of the spark plug 1.

As especially shown in the longitudinal sections of FIGS. 2 and 3, the spark plug 1 is a pre-chamber spark plug, as the ignition electrode 6 is arranged in a pre-chamber 7 which by means of apertures 8 is connected with the combustion chamber of an internal combustion engine (not shown). By way of example, pre-chamber spark plugs are known from EP 0 675 272 A1, to which reference is made with respect to further details and characteristics of pre-chamber spark plugs.

The ignition electrode 6 is arranged on a ceramic insulation element 10 through which runs a connection channel by means of which the ignition electrode 6 is connected to an electric supply line 11. In the connection channel is arranged a connecting line, also designated as center electrode, which connects the supply line 11 with the ignition electrode 6. FIG. 3 shows in details the configuration of the connection line. A first section of the connection line is formed by a ignition electrode support 16 that protrudes into the connection channel and bears the ignition electrode 6. An adjacent section of the connection line is constituted by a vitreous body 13 that contains, e.g., copper and carbon particles which result in a defined protective resistor. In the vitreous body 13 is also embedded a connection piece 14 as another part of the of the connection line which, by means of a roughened surface 15 is positively connected with the vitreous body 13. The connection piece 14 protrudes from the insulation element 10 and by means of a plug-in connection or a threaded joint is connected in a conducting manner with the cable constituting the supply line 11.

The supply line 11 is a high-voltage cable of which the free end protrudes from the pipe housing 4 where it is provided with a clamp contact 12 to be plugged in into the connection fitting of an ignition coil. Due to the flexibility of the cable 11 it is possible to compensate misalignments and thermal expansions that could occur between the firmly mounted spark plug 1 and a firmly mounted ignition coil.

Peak pressures of the order of magnitude of 150 bars regularly occur during the operation of an internal combustion engine that cause combustion gases to seep as leakage gases into the spark plug 1 either through the connection channel or through other sealing points. In order to remove the combustion gases from the pipe housing 4, the herein illustrated spark plug 1 is provided with a venting channel that runs along the supply line 11 or, rather, in the supply line 11.

FIG. 4 shows a diagrammatic cross-section through the cable constituting the supply line 11. The cable 11 has a sheath 27 that surrounds a flexible braid 28 of stranded wires 17, 18. The venting channel 19 is constituted by the interstices 20 between the stranded wires 17, 18 of the flexible braid 28. In order to enlarge the interstices 20 constituting the venting channel 19, a first group of stranded wires 18 is stranded in a first direction of rotation and a second group of stranded wires 17 is stranded in a second opposite direction of rotation to form the flexible braid 28. In such a manner, the interstices 20 of the stranded wires can be enlarged without impairing the transverse pressure stability of the flexible braid 28.

In the illustrated embodiment the venting channel 19 is between a stranded core that is formed by stranded wires 18 that are stranded in a first direction of rotation and surrounding stranded wires 17 that are stranded in a second direction of rotation that is opposite to the first direction of rotation. It is beneficial that the stranded wires 17, 18 are stranded with respect to the flexible braid 28 in such a manner that the number of turns per unit of length is as less as farther outside the corresponding stranded wire 17, 18 is in the flexible braid 28. In such a manner it is possible to achieve that the individual stranded wires 17, 18 are essentially of the same length. An advantage of such a stranding of the stranded wires 17, 18 is that adjacent stranded wires come in contact only over short sections, ideally only at points, and that line contacts that could impede passage of gas are prevented.

Generally it is beneficial that the flexible braid 28 is constituted by several layers of stranded wires 17, 18, whereby the individual layers are stranded in a reversed-lay manner. By way of example, it is beneficial to use three layers, whereby the first innermost layer is stranded in a first direction of rotation, the second layer, above it, is stranded in an opposite direction of rotation and the third outermost layer is stranded in the direction of rotation of the first layer. Especially beneficial are flexible cords with two to five layers, in particular, two to three layers.

Another possibility to enlarge the interstices 20 constituting the venting channel 19, which was also used in the illustrated embodiment, consists in stranding the stranded wires 17, 18 with different diameters to form the flexible braid 28. Preferably, the stranded wires of the first group have a diameter that is 25% to 60%, preferably 30% to 50%, larger than the diameter of the stranded wires of the second group. The center of the flexible cords 28 is preferably constituted by the thicker wires of the first group, but it can also be formed by the thinner wires of the second group. Preferably, a group of stranded wires constitutes at the same time a layer of the flexible cord, but this must not be necessarily the case.

These possibilities to enlarge the interstices 20 constituting the venting channel 19 are applied in the supply line 11 illustrated in FIG. 4 in such a manner that three stranded wires 18 are stranded as a first group with a first direction of rotation to form a stranded core, while the other wires 17 that preferably have a diameter of less than 30% are stranded around the thus formed stranded wire core. In the illustrated example, the stranded wires 18 of the second layer constitute a second group that is stranded in a second direction of rotation, opposite to the first direction of rotation, around the stranded wire core. A third, outermost layer of stranded wires is stranded in the first direction of rotation. In such a manner it is achieved that the venting channel 19 is formed by enlarged interstices 20 between the stranded wire core and the surrounding stranded wires 17.

The supply line 11 of the embodiment illustrated in FIGS. 1 to 3 is arranged in a plastic pipe 21, preferable out of Teflon, into which protrudes the insulation element 10. The supply line 11 is supported and centered by means of the plastic pipe 21. The plastic pipe 21 protrudes from the pipe housing 4 and is provided with an appropriate cable seal in order to prevent intrusion of dirt or humidity into the inside of the pipe housing 4. The gaps inside the plastic pipe 21, especially in the area of the connection piece 14 protruding from the insulation element 10, are filled with a high-voltage insulation compound 22, preferably of a silicone base.

The flexible braid 28 of the connection line 11 is connected to the connection piece 14, protruding from the insulation element 10, by means of a metal conductor barrel 23. This conductor barrel 23 is provided on its inside with a (not shown) groove in order to convey the leakage gases emerging from the insulation element 10, better said from the therein provided connection channel, to the venting channel 19 that in the described embodiment runs in the flexible braid 28 of the supply line 11.

In the illustrated embodiment, the conductor barrel is screwed on to the connection piece 14 that is provided with an external thread for this purpose, which thread fits an internal thread of the conductor barrel 23. However, it is also possible to use the conductor barrel as a plug-in connection with an adequately configured connection piece 14.

In the illustrated embodiment, the conductor barrel 23 is also screwed into a threaded coupling of a terminal element 26 that is locked with the flexible cord of the supply line 11. Also in this case, the conductor barrel 23 can alternatively be used for a plug-in connection with a pin of a terminal element 26. It is also possible to configure the conductor barrel 23 as one piece with the terminal element 26.

In order to be able to achieve highest voltage rise speeds it is generally beneficial that the diameter of the flexible braid 28 in the cable 11 deviates less than 10%, preferably less than 15%, of the diameter of the connection 14 protruding from the insulation element 10 of the ignition electrode 6.

It is possible that, in the case of an erroneously adjusted mixture ratio of the gas mixture to be ignited, peak pressures are generated, that are so high that the insulation element 10 is pushed into the pipe housing 4. To discharge combustion gases intruding into the pipe housing 4 before they cause acceleration of the insulation element 10 in the pipe housing to dangerous speeds, just like a rifle bullet, the illustrated spark plug is provided with other venting channels 24 in the form of apertures on the surface of the pipe housing 4.

In order to increase the pressure resistance of the spark plug 1, the insulation element 10 is secured with a mounting (see FIGS. 3, 7 and 8) that is welded to the pipe housing 4. Additionally, the ignition head 2 is also welded to the pipe housing 4. The danger that, due to unexpected high peak pressures, the insulation element 10 could be pushed into the pipe housing 4 is met by the mounting 36 welded to the pipe housing 4, which mounting grips around a torus of the insulation element 10.

As an additional safety measure against the effects of unexpected high peak pressures, the pipe housing 4 is provided with a retainer ring 25 whose inside diameter is less than the largest diameter of the insulation element 10. The outside diameter of the retainer ring 25 is larger than a lead aperture of an end piece 5 to which the metal pipe housing 4 is joined, preferably welded, at its end opposite to the ignition head 2. Even under the most adverse conditions, in such a manner it is prevented that the insulation element 10 comes out of the pipe housing 4 due to the retainer ring 25 in combination with the end piece 5. In the illustrated embodiment, the end piece 5 is simultaneously provided with the hexagon 5 for the screwing in of the external thread 3 into a corresponding aperture of the internal combustion engine.

FIG. 5 shows another embodiment of a spark plug 1 that essentially differs from the embodiment described by means of FIGS. 1 to 3 in that a plastic pipe for the support of the supply line 11 is omitted. Instead, the inside of the pipe housing 4 is filled with an appropriate insulation compound 30, preferably of a silicone base. Especially preferred are silicone gels. Suitable silicone gels are commercially available as two pourable compound mixtures. A clamp collar 35 provides that the venting channels 24 on the surface of the pipe housing 4 remain unobstructed and that their function is not impaired by the insulation compound 30. The supply line 11 is centered by a cable bushing 31, preferably out of Teflon, and a water protection cap 32 which, additionally, protect against a damage caused by wall friction effects.

According to FIG. 6, as alternative to the clamp contact 12 illustrated in FIGS. 1 to 3, the cable end can also be provided with a coil plug 33 that can be directly plugged into a ignition coil. The cable 11 is provided at its free end with a gas vent 34 into which runs the venting channel 19 inside the cable 11. Such a gas vent 34 can be provided in the coil plug 33, illustrated in FIG. 6, as well as in the clamp contact 12.

FIG. 7 shows a longitudinal section of another embodiment of a spark plug in which, as in the embodiment illustrated in FIG. 5, the inside of the pipe housing 4 is filled with silicone gel 30. Further, the embodiment shown in FIG. 7 essentially differs from the embodiment illustrated in FIG. 2 by the connection of the connecting line (center electrode 40), traversing the insulation element 10, of the ignition electrode 6 to the flexible braid 28 of the supply line 11 and the cable bushing 31 with which the pipe housing 4 is closed at the end opposite the ignition head 2.

The center electrode 40 protrudes with a section from the insulation element 11 that is electrically in contact with the flexible braid 28 of the supply line 11. The section of the center electrode 40 protruding from the insulation element 11 is provided for this purpose with a blind hole into which is inserted the flexible braid 28. In order to improve the contacts, the flexible braid 28 can be either pressed or welded into the blind hole. The blind hole runs in the longitudinal direction of the center electrode 40 and it is preferably configured as a central bore.

The connecting point of the supply line 11 to the central electrode 40 is surrounded by a sheath 45 which in the embodiment is configured as a bushing. This sheath 45 encloses at one end the insulation element 10 and on its other end the supply line 11, in particular, the sheathing of the cable constituting the supply line 11. In order to minimize the risk of an impairment of the electric contact between the center electrode 40 and the supply line 11, the sheath 45 is connected to the insulation element 10 and the supply line 11 in a manner capable of bearing tensile loads. On the one hand, such tensile loads can occur at the time of assembly and, on the other hand, they can be caused by a thermal expansion during the heating-up of the spark plug while in operation.

In the simplest case, a connection capable of bearing tensile loads is possible by a positive connection of the sheath 45 with the insulation element 10 and the cable 11, e.g., if the metal sheath 45, after the positioning around the insulation element 10 and the cable 11, is pressed around them. Alternatively or additionally, by a corresponding configuration of the inside of the sheath 45 and/or the outside of the insulation element 10 and the cable sheathing of the cable 11, e.g., a groove, it is possible to create a positive connection. An integral joint, e.g., by gluing, is also possible.

Instead of a sheath 45, the protective covering can also be constituted by a heat-shrinkable sleeve. With an appropriate dimensioning of the heat-shrinkable sleeve it can be achieved that it surrounds the insulation element 10 and the sheathing of the cable 11 in a gastight manner and capable of bearing tensile loads.

The sheath 45 surrounds the insulation element 10 and the supply line 11 in a gastight manner. For this, the sheath 45 presses in a sealing manner an O-ring against the insulation element 10. In the illustrated embodiment, the O-ring 41 is in a groove of the sheath 45.

The end of the pipe housing 4, opposite of the ignition head 2, is closed by a cable bushing that fastens the cable 11 in a section surrounded by the cable bushing with respect to the pipe housing 4. In such a manner is created a strain relief that prevents that, because of the effect of force on the cable 11, the electric contact between the flexible braid 28 of the cable 11 and the central electrode 40 is impaired.

The cable bushing is provided by a collet 42 and a clamp collet 43 that is pressed by the collet 42, so that the cable 11 running through it is positively fastened. The collet 42 is made out of metal and is provided with an external thread 44 that is screwed into the fitting internal thread of the pipe housing 4 or into the hexagon 5 connected to the pipe housing 4. The collet 42 surrounds with one end the plastic clamp collet 43. The inside diameter of the collet 42 decreases starting from the end facing the clamp collet 43. Thus, by screwing the collet 42 into the internal thread of the hexagon 5, the collet 42 is pushed over the clamp collet 43, so that, because of the decreasing diameter, the latter is increasingly stronger compressed. In order to prevent that the clamp collet 43 is pushed into the inside of the pipe housing 4, the clamp collet 43 is provided with a collar with which it is supported.

In the embodiment illustrated in FIG. 7, the end of the cable 11 is provided with a clamp contact 12, as in the embodiment illustrated in FIG. 2. FIG. 8 shows another embodiment that differs from the embodiment illustrated in FIG. 7 in that the end of the cable, as in the embodiment illustrated in FIG. 5, is provided with a coil plug 33 shown in FIG. 6. The collet 42 of the cable bushing is protected by a water protection cap 32.

REFERENCE NUMBERS LIST

1 Spark plug
2 Ignition head
3 External thread
4 Pipe housing
5 Hexagon
6 Ignition electrode
7 Pre-chamber
8 Pre-chamber aperture
10 Insulation element
11 Supply line
12 Clamp contact
13 Vitreous body
14 Connection piece
15 Surface of the connection piece
16 Ignition electrode support
17 Stranded wire
18 Stranded wire
19 Venting channel
20 Stranded wire interstice
21 Plastic pipe
22 Insulation compound

23 Conductor barrel
24 Venting channel
25 Retainer ring
26 Terminal element
27 Cable sheath
28 Flexible braid
30 Insulation compound
31 Cable bushing
32 Water protection cap
33 Coil plug
34 Gas vent
35 Clamp collar
36 Mounting
40 Center electrode
41 O-ring
42 Collet
43 Clamp collet
44 External thread of the clamp collet
45 Sheath

The invention claimed is:

1. A spark plug for igniting a combustible gas mixture in an internal combustion engine, comprising:

an ignition electrode, an electrical supply line connected to the ignition electrode;

a ceramic insulation element surrounding the electrical supply line;

a pipe housing surrounding the ceramic insulation element and the electrical supply line, the pipe housing supporting an ignition head; and a venting channel for discharging combustion gases, infiltrating the pipe housing, from the pipe housing, the venting channel being disposed along the supply line.

2. A spark plug according to claim 1, wherein the venting channel is disposed in the supply line.

3. A spark plug according to claim 1, wherein the supply line is provided at an end opposite the ignition electrode with a gas vent at an end of the venting channel.

4. A spark plug according to claim 1, further comprising another venting channel configured as an aperture in a surface of the pipe housing.

5. A spark plug according to claim 1, wherein the electric supply line is connected to the ignition electrode by a conductor barrel with a plug-in connection or a threaded joint.

6. A spark plug according to claim 1 wherein the ignition head includes external threads and is welded to the pipe housing.

7. A spark plug according to claim 1, wherein the supply line is connected to the ignition electrode by a center electrode, disposed through the insulation element, and the spark plug further comprises a sheath covering a contact point between the supply line and the center electrode.

8. A spark plug according to claim 7, wherein the sheath surrounds the insulation element.

9. A spark plug according to claim 1, wherein the supply line comprises a cable.

10. A spark plug according to claim 9, wherein one end of the pipe housing is closed by a cable bushing that fastens the cable in a section surrounded by the cable bushing.

11. A spark plug according to claim 10, wherein the cable bushing comprises a collet and a clamp collet onto which the collet is pushed thereby compressing the cable.

12. A spark plug according to 9, wherein the cable comprises a flexible braid of stranded wire.

13. A spark plug according to claim 12, wherein the venting channel is formed by interstices that are between the stranded wires of the flexible braid.

14. A spark plug according to claim 13, wherein stranded wires with different diameters are stranded for the flexible braid.

15. A spark plug according to claim 13, wherein a first group of stranded wires is stranded in a first direction of rotation and a second group of stranded wires is stranded in a second direction of rotation opposite to the first direction of rotation.

16. A spark plug according to claim 15, wherein the first group of stranded wires forms a first layer and the second group forms a second layer of stranded wires of an at least two-layered flexible braid, wherein the adjacent layers are stranded in a reversed-lay.

* * * * *